US006210247B1

(12) United States Patent
Rodríguez Ferré

(10) Patent No.: US 6,210,247 B1
(45) Date of Patent: Apr. 3, 2001

(54) STRUCTURE FOR CHILDREN'S GAMES

(75) Inventor: Jose Manuel Rodríguez Ferré , Ibi (ES)

(73) Assignee: Rodriguez-Martinez, S.C. Construction, Ibi (ES)

( * ) Notice: Subject to any disclaimer, the term of this patent is extended or adjusted under 35 U.S.C. 154(b) by 0 days.

(21) Appl. No.: 09/033,797

(22) Filed: Mar. 3, 1998

(30) Foreign Application Priority Data

Mar. 26, 1997 (ES) ..... 9700795 U

(51) Int. Cl.[7] ..... A63H 3/16; A63H 3/52; A63B 9/00

(52) U.S. Cl. ..... 446/99; 446/476; 482/35

(58) Field of Search ..... 446/99, 100, 97, 446/85, 476, 478; 482/35, 36

(56) References Cited

U.S. PATENT DOCUMENTS 3,572,698 * 3/1971 Greenly ..... 482/35 X
5,387,165 * 2/1995 Warren ..... 446/476 X
5,618,246 * 4/1997 Zheng ..... 482/35
5,620,396 * 4/1997 Westphal ..... 482/35
5,692,993 * 12/1997 Dunn, Jr. et al. ..... 482/35
5,711,253 * 1/1998 Phillips et al. ..... 482/35 X
5,711,744 * 1/1998 Stwarcutter et al. ..... 482/35
5,722,446 * 3/1998 Zheng ..... 482/35 X
5,741,189 * 4/1998 Briggs ..... 482/35 X

* cited by examiner

*Primary Examiner*—D. Neal Muir
(74) *Attorney, Agent, or Firm*—Lackenbach Siegel Marzullo Aronson & Greenspan PC

(57) ABSTRACT

Children's game structure having two modular parts (1) and (2), of an arbitrary number which combine to form a number of ogival arches (5) **(5*a*) (5*b*) (5*c*) and which are joined together in line one after the other simulating the rings of a centipede and configuring a tunnel fitted at both ends with flat, vertical parts (17) and (18) representing the centipede's head and tail, with openings (19) and (20)** for the children to enter and exit the centipede. The game structure is applicable for children's games of the type that allow the children to crawl through the inside or on top of the outside of the tunnel and the structure is easy to assemble and disassemble for storage as it only requires a small amount of storage space and no tools.

6 Claims, 2 Drawing Sheets

STRUCTURE FOR CHILDREN'S GAMES

SUMMARY OF THE INVENTION

This invention entails the design of a structure comprised of two basic modules which, on being fitted together, form a modular arch which can be attached in line to other similar modular arches to form an elongated, winding structure of an optional layout and length depending upon the method used to connect said modules and of the number of modules employed.

The result is a structure in the shape of a tunnel or an ogival-shaped duct, which, as a whole, simulates the body of a fanciful centipede, with additional parts for the head and tail, each of which are equipped with round openings for the entry of children, who can go through the inside of the structure, it being possible for the adults to monitor the children from the outside thanks to the round windows located at different levels along the walls of the modules.

The structure is equipped with stable added supports which comprise the worm's feet and has a curved, smooth outer surface, which forms the worm's back on which the children can play as part of their games.

This structure is assembled without any screws by an adult, on a flat surface, and is stored, after being broken down into its different modules, requiring very little space.

For the purpose of facilitating the explanation, a sheet of drawings is attached to this descriptive report on which one embodiment which is being provided as an example is shown.

DETAILED DESCRIPTION OF THE INVENTION

Figure 1:
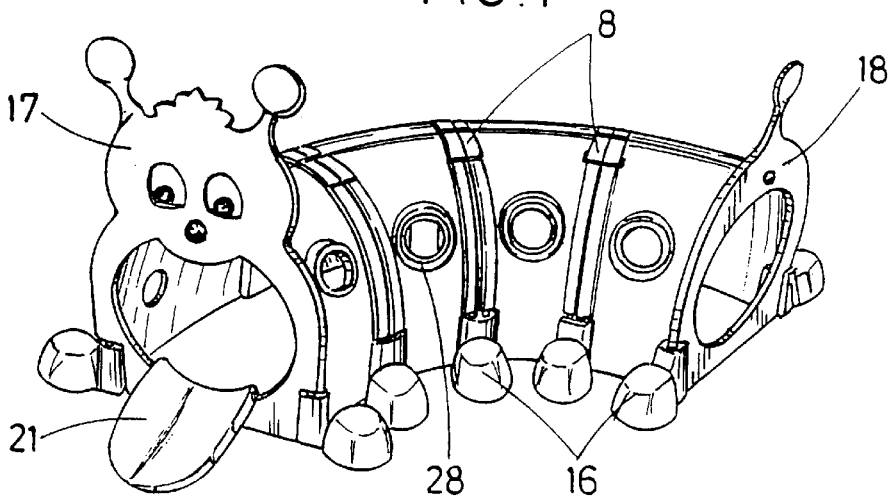
FIG. 1 is a perspective view of the assembled structure.
Figure 2:
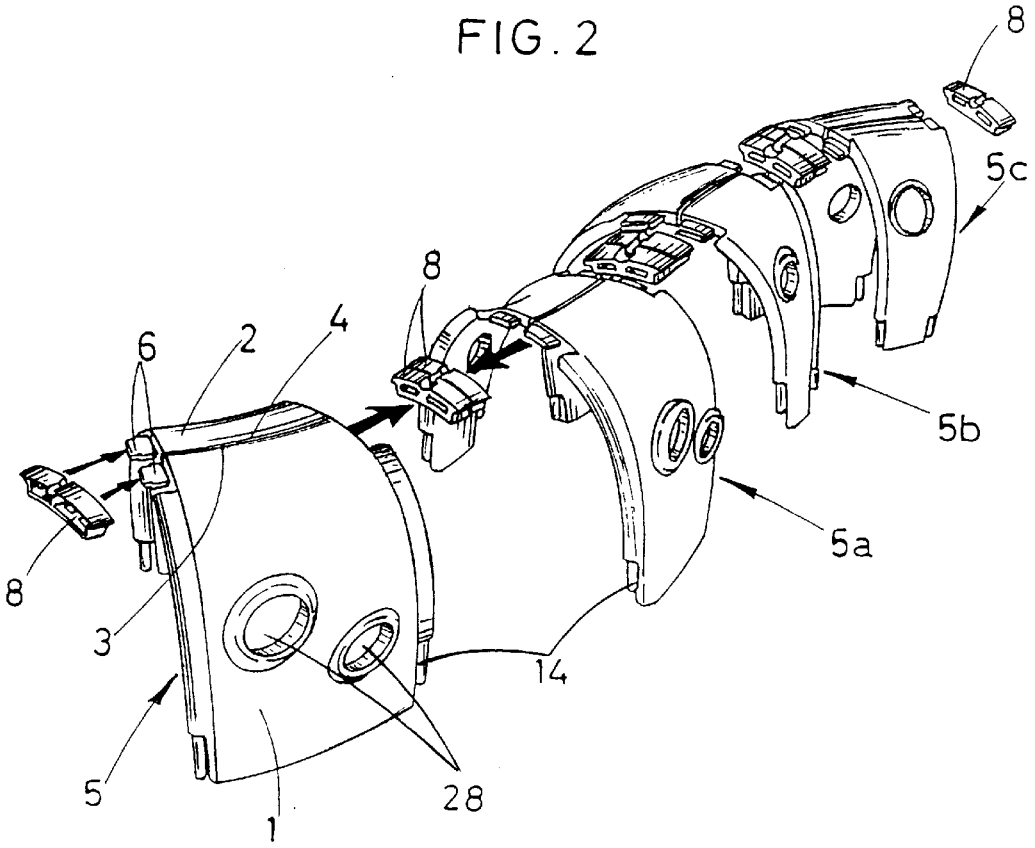
FIG. 2 shows a breakdown in perspective of the structure in which the method for assembling the different modules is illustrated in conjunction with the means for anchoring the two modules and or joining together each pair of these modules one after the other.
Figure 3:
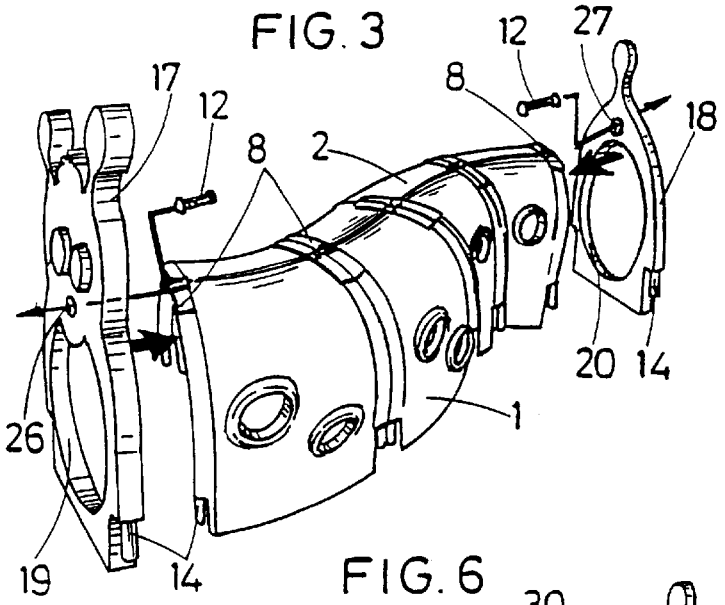
FIG. 3 is a view similar to the previous one, in which each pair of modules has already been joined together, the structure being fitted at one end with the head piece and at the other with the tail piece.
Figure 4:
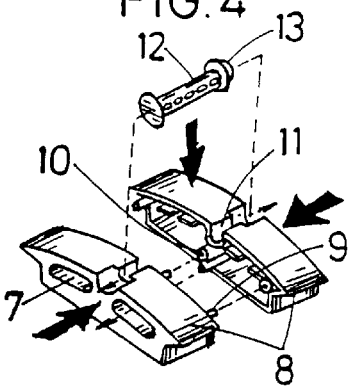
FIG. 4 and FIG. 5 each show details of the anchorings for fitting the modules together.
Figure 5:
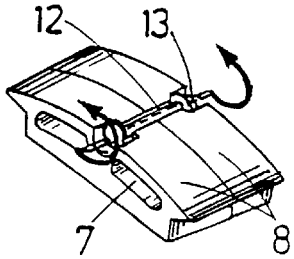
Figure 6:
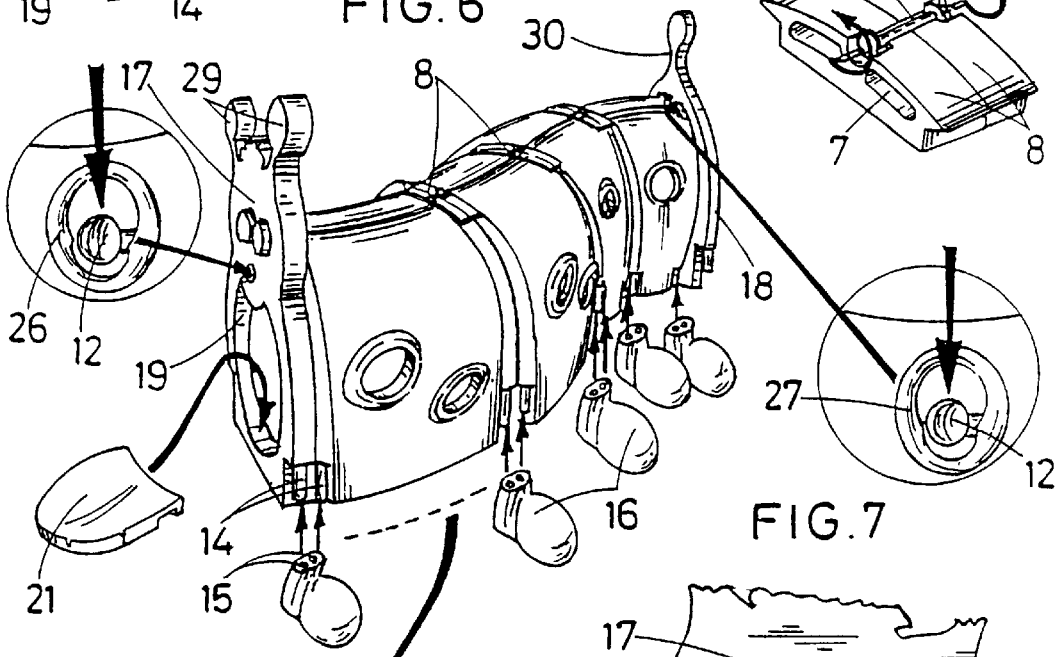
FIG. 6 shows the structure practically fully assembled, ready for mounting the supporting feet.
Figure 7:
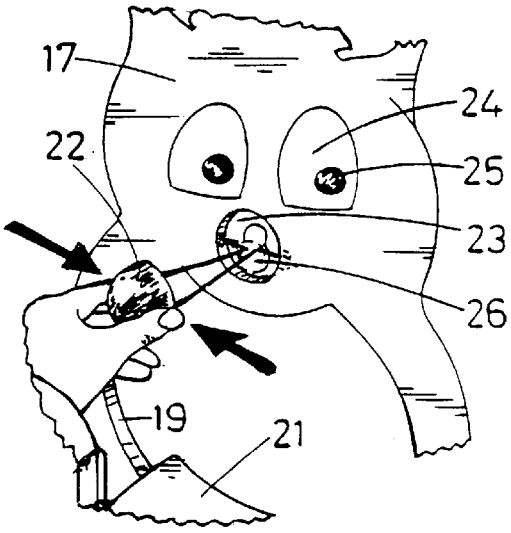
FIG. 7 shows assembly of the flexible nose onto the head piece.
Figure 8:
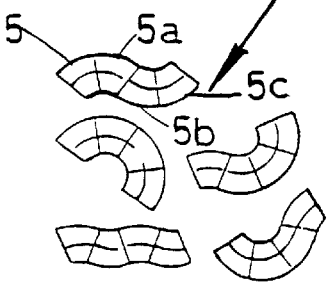
FIG. 8 shows different plan views of the structure, depending upon option ways of assembling the same.

Referring to the Figures, one can see a structure for children's games in the process of being assembled, starting from two modular parts -1- and -2- which each form arched planes in the regard of their height and width, having an upper side for coupling which, in one case is curved into a concave -3- and, in the other, is a convex curve -4-, to be joined together to form a modular ogival or tapered arch, designed in general by -5-, which can be fitted together in line, one after the other, with the same type of modular arches -5*a*-, -5*b*-, -5*c*-etc., comprising a structure in a tunnel-like shape, the configuration of which will depend upon the optional way in which these modular arches -5- are joined together, and the length thereof depending upon the number of these modules employed.

The parts -1- and -2-, which comprise the modules -5-, are joined together by means of some flat tenons -6- with which said parts -1- and -2- are equipped at the top, and which are press-fitted into holes -7- of some separate parts -8-. These parts -8-, are fitted to the fixed twin parts on adjacent modules -5- by means of tongue jointing -9- and -10-. Each pair of parts -8- forms an upper, crosswise groove -11-, round in cross-section and narrow-entry, into which one flat jointing member -12-, fitted with two heads -13- one of which is workable, for turning for securing for use.

The bottom ends of the parts -1- and -2- have some pegs -14-, each pair of which is inserted into the holes -15- in parts -16- which simulate some fanciful feet on which the structure as a whole rests.

The end modules -5- and -5*c*- are each connected to flat, vertical parts marked -17- and -18-, provided with respective openings -19- and -20- for child entry. Part -17- represents the fanciful head of a worm, opening -19- and -20- for child entry. Part -17- represents the fanciful head of a worm, opening -19- corresponding to the mouth, at the edge of which a fixed part -21- is attached to simulate the tongue. A flexible spherical cap simulates the nose and is fit into the hole -23- by squeezing on its sides. Some transparent capsules -24- house round, open parts -25- which simulate the eyes. Part -18- simulates the worm's tail.

Both parts -17- and -18- are joined to the modules by means of a part -8- and pertinent connecting member -12- which is inserted into holes -26- and -27- on said parts. Likewise, parts -17- and -18- have pegs -14- for fitting into the feet -16-.

This structure forms a sort of tunnel, with two open ends -19- and -20- as children's entrance and exit, which can be circular along the full length of the structure, the component parts of which -1- and -2-, have windows -28- providing for inside-outside monitoring. This structure comprises the winding body of a fanciful centipede, which is smooth and curved in a convex shape on the outside, on which the children can sit and climb and hold onto the antennas -29-, the head and tail -30-.

As follows from the preceding description, this structure requires no screws, bolts or auxiliary tools for assembly, a process which can easily be performed by an adult. Disassembly is also simple, and the component parts require a minimal amount of space for storage.

What is claimed is:

1. A structure for children's games comprising a plurality of modular parts (1 and 2), of an arbitrary number, and in which each comprise curved planes in regard to their height and width, having a top side for coupling purposes, which in the case of party (1) is a concave curve (3) and in the case of part (2), is a convex curve (4) and which form, when combined, a modular tapered arch; (5), which may be fitted together and joined one after the other in a line to similar modular arches resulting in a tunnel-like structure which may be configured as a body of an insect or other organism/animal having a head and tail, each of which may be represented by flat, vertical parts, fitted to end arches, provided with openings which lead into the structure for the children to enter and exit the insect.

2. A structure for children's games as in claim 1, wherein said modular parts each have on the top side of their lengthwise sides, a pair of lips in the form of tenons for press-fitting into respective apertures/holes in an elongated, crosswise part on a coupling side, said crosswise part comprising a tongue for connection with similar crosswise parts fitted to an adjacent modular arch, each pair of crosswise parts comprising a narrow-fit, crosswise groove into which a flat-cross-section connection member with end heads for tightening both crosswise parts, one of which comprises a working head for turning said flat-cross section connection member into a locked position.

3. A structure for children's games as in claims 1 or 2 wherein said modular parts and head, tail have some vertical pegs on their bottom ends, each pair of pegs being inserted into pairs of holes drilled in flat-bottomed, foot simulating parts, which act as supports of the structure.

4. A structure for children's games as per anyone of claims 1 or 2, characterized in that said head and tail parts, each have seats engaging a head of the connection member, which links them to a crosswise part of said arches.

5. A structure for children's games as per claim 1, including one or more windows in said modular parts forming said modular arches for enabling monitoring of a child inside said structure.

6. A structure for children's games as per claim 5, wherein said windows are on both said concave and convex curve sides of said modular arches.

* * * * *